United States Patent [19]

Patel et al.

[11] Patent Number: 4,480,957

[45] Date of Patent: Nov. 6, 1984

[54] DYNAMIC RESPONSE MODIFICATION AND STRESS REDUCTION IN DOVETAIL AND BLADE ASSEMBLY

[75] Inventors: Manubhai M. Patel, Clifton Park; Diether E. Carreno, Schenectady, both of N.Y.

[73] Assignee: General Electric Company, Schenectady, N.Y.

[21] Appl. No.: 484,882

[22] Filed: Apr. 14, 1983

[51] Int. Cl.[3] ..... F01D 5/32

[52] U.S. Cl. ..... 416/220 R; 416/219 R; 416/500

[58] Field of Search ..... 416/220 R, 500, 219 R, 416/220 A, 106, 107

[56] References Cited

U.S. PATENT DOCUMENTS

| | | | |
|---|---|---|---|
| 1,229,490 | 6/1917 | London | 416/220 |
| 1,699,747 | 1/1929 | McKay | 416/220 |
| 2,686,655 | 8/1954 | Schorner | 416/220 |
| 2,942,843 | 6/1960 | Sampson | 416/500 |
| 3,292,900 | 12/1966 | Pettersen | 416/500 |
| 3,385,512 | 5/1968 | Bandukwalla | 416/500 |
| 3,689,177 | 9/1972 | Klassen | 416/220 |
| 3,720,480 | 3/1973 | Plowman et al. | 416/220 |
| 3,887,298 | 6/1975 | Hess et al. | 416/220 |

FOREIGN PATENT DOCUMENTS

| | | | |
|---|---|---|---|
| 607452 | 10/1960 | Canada | 416/500 |
| 826332 | 12/1951 | Fed. Rep. of Germany | 416/220 |
| 186004 | 11/1982 | Japan | 416/219 R |
| 126169 | 9/1949 | Sweden | 416/220 |

*Primary Examiner*—Henry C. Yuen
*Assistant Examiner*—John Kwon
*Attorney, Agent, or Firm*—J. C. Squillaro

[57] ABSTRACT

A dovetail of a rotor blade is preferentially remove to thereby modify the support given to the root of a rotor blade. The modified support changes the vibrational characteristics of the rotor blade for reducing the tendency toward crack initiation. In one embodiment of the invention, one or more damping masses are fitted into the dovetail slot within the removed portion of the dovetail. The damping masses are loaded outward against the base of the rotor blade by centrifugal force and frictionally damp some of the vibrational energy of the rotor blade.

9 Claims, 10 Drawing Figures

DYNAMIC RESPONSE MODIFICATION AND STRESS REDUCTION IN DOVETAIL AND BLADE ASSEMBLY

BACKGROUND OF THE INVENTION

The present invention relates to rotating machinery and, more particularly, to rotating machinery of the type having a blade supported by a dovetail to the perimeter of a rotatable wheel.

In axial flow compressors and turbines, it is conventional to form a unified assembly consisting of a dovetail fittable into a dovetail slot in a wheel with a cantilevered blade or bucket extending radially outward therefrom. Stress concentrations can occur at the junction of the cantilevered blade and the dovetail which may lead to initiation of cracking and, in extreme case, failure of the assembly. Such stress concentrations can be attributed to the rigid fixation of the dovetail in the wheel combined with flexural bending of the blade vibrating in one of its vibration modes such as, for example, its fundamental vibration mode.

In some such rotating apparatus, it has been common to employ interlocking tips, tie wires or midspan shrouds on large blades in an attempt to interlock the blades and either change their resonant frequency or to damp out vibrations.

Prediction of vibrational problems is extremely difficult, if not impossible, at the design stage since rotor blade dynamic characteristics can, in many cases, only be fully specified after a full-sized functional prototype has been built and tested. Correction of vibrational problems at that stage is extremely expensive. Furthermore, impending failure of a blade is typically a high cycle fatigue event which may not become evident until the apparatus has been in operation for an extended period. It is possible that an impending cracking problem may not be discovered in a blade until after years of operation.

Some of the possible fixes, including tip interlocks, wires, shrouds, and other techniques not only are expensive and produce delays but also may result in inefficiencies and power output losses which compromise the defined aerodynamic characteristics of the device containing the blade.

Such other solutions may include, for example, removable blades which may produce non-uniform loading of the attached dovetail despite precision machined arc segments. Removable blades may also lead to problems in sealing between extended blade platforms which may decrease compressor efficiency.

OBJECTS AND SUMMARY OF THE INVENTION

Accordingly, it is an object of the invention to provide a blade and dovetail system which overcomes the drawbacks of the prior art.

It is a further object of the invention to provide a blade and dovetail having selectable flexibility in the dovetail region for reducing vibration-derived stresses and/or for shifting the modes and natural frequencies of vibration.

It is a further object of the invention to reduce the possibility of impending cracking at the relatively rigid junction of the blade root and the dovetail by selectively reducing the mechanical support provided to the dovetail by a dovetail slot.

It is a further object of the invention to provide apparatus for damping vibration of a dovetail platform.

It is a further object of the invention to provide damping weights which are urged into frictional contact with a dovetail platform for damping vibrational motion of the dovetail platform.

According to an embodiment of the invention, there is provided a rotating component comprising a wheel, a plurality of dovetail slots in a surface of the wheel, a plurality of rotor blades each having a dovetail and a cantilevered aerodynamic portion, the dovetail being fittable into the dovetail slot for cantilevered support of the aerodynamic portion radially outward from the wheel, and means for modifying a support of the dovetail by the dovetail slot whereby a stress in the rotor blade is modified.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Although the present invention may be applied in any suitable apparatus in which a cantilevered blade is supported on a wheel by a dovetail, for concreteness of description, the illusrative example employed herein is one of the stages in a gas turbine axial flow compressor. Except for some of the terminology employed, the invention is equally applicable to other devices of this general type.

Figure 1:
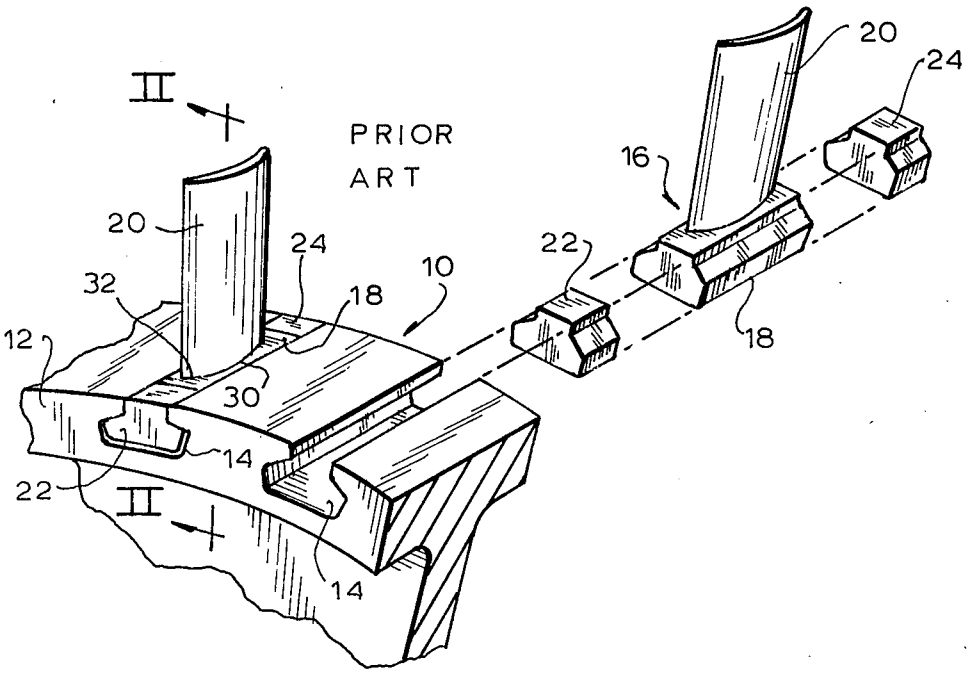
FIG. 1 is perspective view of a partially disassembled compressor stage according to the prior art.

Referring now to FIG. 1, there is shown, generally at 10, a portion of a compressor stage according to the prior art in which a wheel 12 includes dovetail slots 14 machined in its perimeter. A plurality of rotor blades 16 have a dovetail 18 accurately fittable into a respective dovetail slot 14. An aerodynamic portion 20 is generally integrally formed with dovetail 18.

As is conventional, dovetail 18 is shorter than dovetail slot 14. Spacers 22 and 24 having a cross section corresponding to dovetail 18 are inserted into dovetail slot 14 at opposed ends of dovetail 18. Spacers 22 and 24 are affixed in dovetail slot 14 by any conventional means such as, for example, by staking (not shown) to thereby constrain dovetail 18 in the longitudinal direction.

Figure 2:
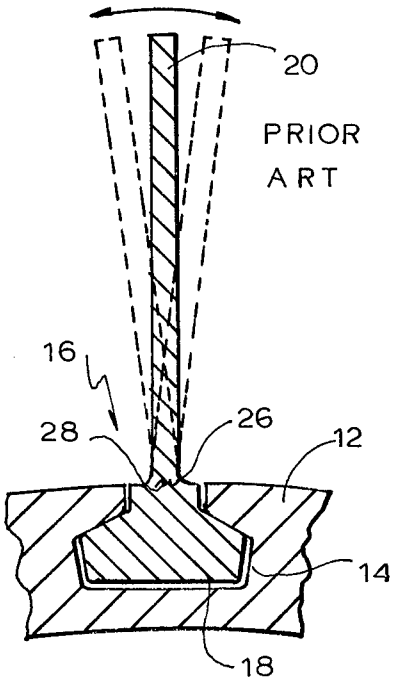
FIG. 2 is a cross section taken aong II—II of FIG. 1 to which reference will be made in illustrating the problem sought to be solved by the present invention.

Referring now to FIG. 2, a rotor blade 16 is shown with its aerodynamic portion vibrating in its fundamental vibrational mode between an equilibrium position shown in solid line and extreme positions shown greatly exaggerated in dashed line. Dovetail 18 remains fixed relatively rigidly to wheel 12 by its interfit with dovetail slot 14. Thus, stresses from the vibration of aerodynamic portion 20 tend to concentrate at a root 26 where aerodynamic portion 20 joins dovetail 18. Root 26 thus represents a likely point for crack initiation which may then propagate into a crack 28.

Referring again momentarily to FIG. 1, analysis and experience indicate that crack initiation is most likely to occur in the vicinity of midspan 30 or at one or both of the ends 32 of aerodynamic portion 20 where it joins dovetail 18.

Figure 3:
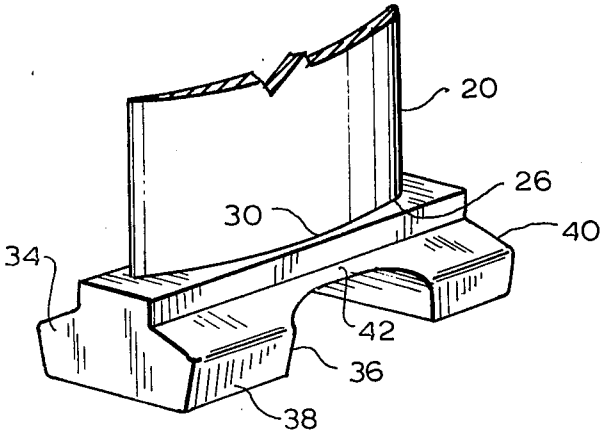
FIG. 3 is a perspective view of a portion of a rotor blade having a modified dovetail according to an embodiment of the present invention.

Referring now to FIG. 3, an embodiment of the invention is shown which is directed toward relieving stress concentrations at midspan 30. An aerodynamic portion 20 is joined to a modified dovetail 34 which has a removed portion 36 joining end portions 38 and 40. Removed portion 36 reduces the support for aerodynamic portion 20 so that a platform region 42 obtains substantially less support from dovetail slot 14 as compared to end portions 38 and 40 which receive full support. By reducing the support for midspan 30 of aerodynamic portion 20, the stress distribution in root 26 and the dynamic response of aerodynamic portion 20, including its modes, resonances and natural frequencies may be changed. By selectively choosing the position and amount of material removed in removed portion 36, the stress distribution pattern in root 26 may be tailored to even the stress pattern and to thereby reduce the possibility of crack initiation. The ability of the present invention to modify or tailor the dynamic response of rotor blade 16 permits shifting the locations at which points of maximum stress may occur to regions where their effects can be tolerated. In addition, by permitting change in the blade dynamic response frequencies, the present invention may avoid mechanical resonances which may otherwise excite rotor blade 16.

Figure 4:
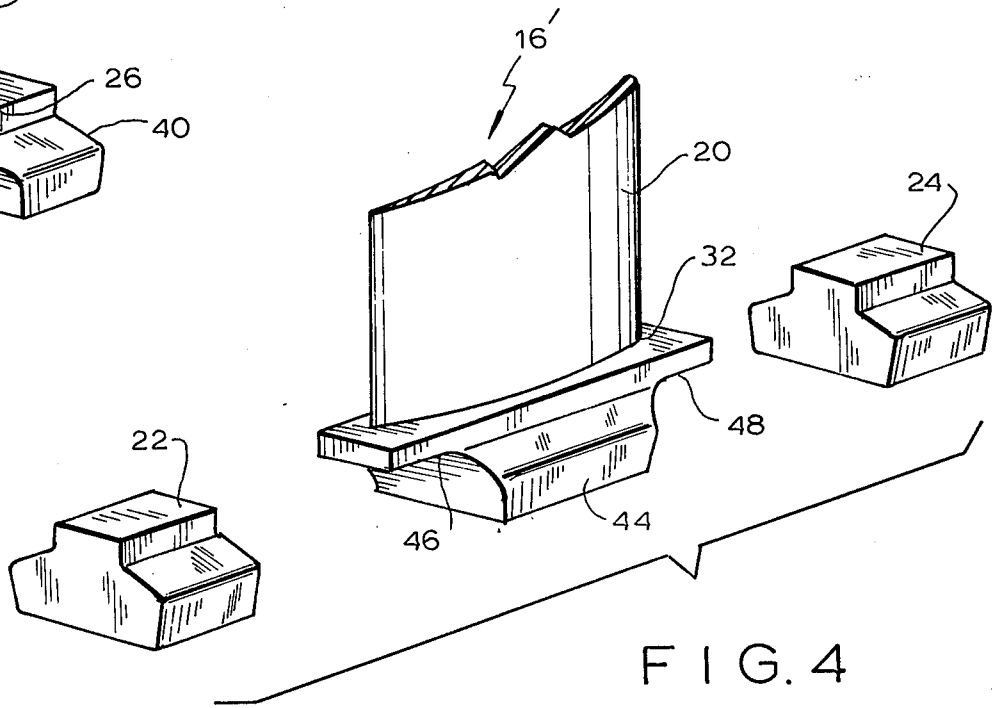
FIG. 4 is a perspective view of a portion of a further rotor blade and its associated spacers according to a second embodiment of the invention.

The embodiment of the invention in FIG. 4 may be employed to tailor the stresses in a rotor blade 16' where it appears that excessive stresses may be found at the junction of ends 32 of aerodynamic portion 20 with a modified dovetail 44. In this embodiment, first and second removed portions 46 and 48 reduce the support for aerodynamic portion 20 under ends 32 of aerodynamic portion 20. As in the preceding embodiment, this reduction in support at one or more specific locations may tailor the stress distribution into improved uniformity.

The embodiments of FIGS. 3 and 4 may, of course, be combined in special instances. That is, an end removed portion may be employed at one end of a dovetail and a center removed portion may be used in the same dovetail without employing a removed portion at the remaining end.

Figure 5:
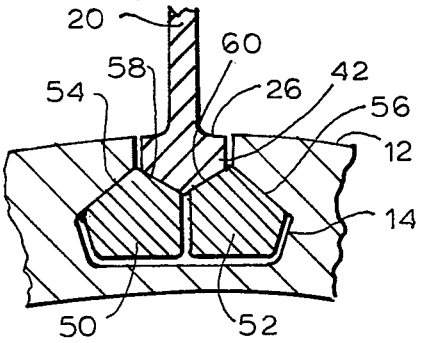
FIG. 5 is a cross section of a modified dovetail including a pair of damping masses according to an embodiment of the invention.
Figure 6:
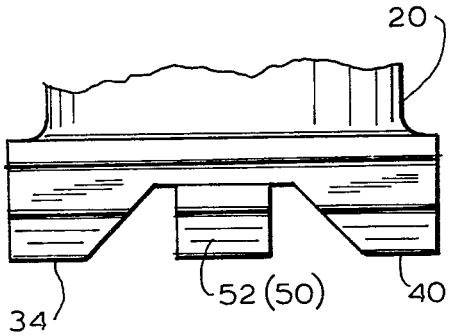
FIG. 6 is a side view of a rotor blade with damping masses in a central location.
Figure 7:
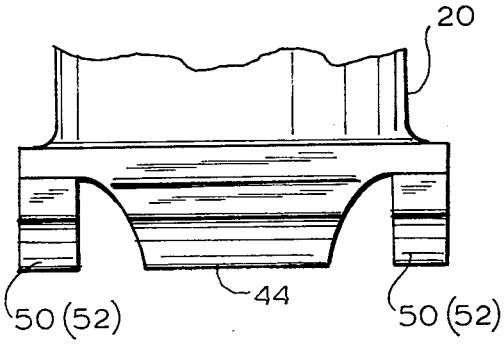
FIG. 7 is a side view of a rotor blade with damping masses in end locations.

Referring now to FIG. 5, there is shown additional apparatus for reducing vibration and modifying the stress distribution in the root of aerodynamic portion 20. First and second damping masses 50 and 52 are placed in dovetail slot 14 in the hollowed-out region of FIG. 3 or 4. Damping masses 50 and 52 are urged radially outward by centrifugal force into frictional contact with surfaces 54 and 56 on the perimeter of dovetail slot 14 and into frictional contact with surfaces 58 and 60 of platform region 42. As platform region 42 is rotated by vibration of aerodynamic portion 20, frictional losses are induced in platform region 42 by its frictional contact with surfaces 58 and 60. In addition, further frictional losses are obtained by the frictional contact between surfaces 54 and 56 and abutting regions of dovetail slot 14. As noted, damping masses 50 and 52 may be employed in the embodiment of FIG. 3 as shown in FIG. 6 and also in the embodiment FIG. 4 as shown in FIG. 7.

Figure 8:
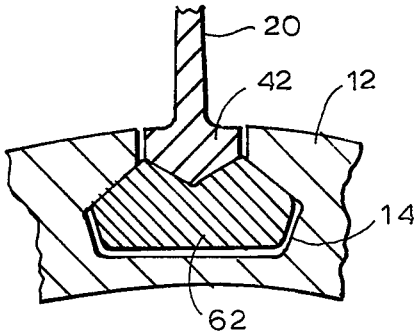
FIG. 8 is a cross section of a further embodiment of the invention showing a one-piece damping mass.

Referring now to FIG. 8, a one-piece damping mass 62 may be indicated in some situations to provide the desired loss of kinetic energy from aerodynamic portion 20.

Figure 9:
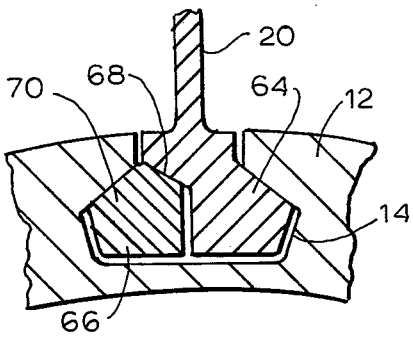
FIG. 9 is a cross section of a modified dovetail and a single damping mass which provides asymmetric damping and support for an aerodynamic portion.

Referring now to FIG. 9, there is shown an embodiment of the invention which provides asymmetric damping properties. In this embodiment, a modified dovetail 64 is only partly removed to receive a single damping weight 66 which is loaded against a surface 68 of modified dovetail 64 and against a surface 70 of dovetail slot 14 by centrifugal force. It would be clear to one skilled in the art that the stiffness imparted to aerodynamic portion 20 by modified dovetail 64 differs in the two lateral directions of motion of aerodynamic portion 20. Thus, where such asymmetric damping is desirable, the embodiment of FIG. 9 may be employed.

Figure 10:
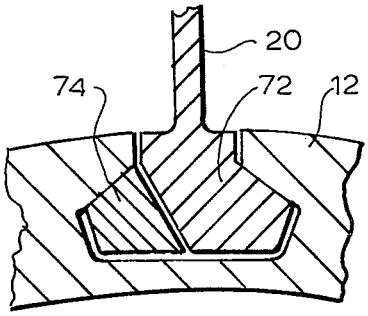
FIG. 10 is a further embodiment of the invention providing asymmetric support and damping.

Referring to FIG. 10, there is shown a further embodiment of the invention wherein a modified dovetail 72 includes a removed portion which receives a damping weight 74.

Other shapes and interfaces between damping weights and the remainder of the apparatus may be derived by one skilled in the art without departing from the spirit and scope of the invention.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A rotating component comprising:

a wheel;

at least one dovetail slot in a peripheral surface of said wheel;

at least one rotor blade;

said rotor blade including an aerodynamic portion and a dovetail;

said dovetail being fittable within said dovetail slot for cantilevered support of said aerodynamic portion radially outward from said wheel;

a removed portion of said dovetail within said dovetail slot, said removed portion being effective to form a platform portion on said dovetail adjacent a root portion of said aerodynamic portion, said platform portion being substantially unsupported by said dovetail slot;

at least one of an extent and a location of said platform portion being effective for modifying a support of said dovetail by said dovetail slot, as compared to a dovetail not containing a removed portion, whereby a stress in said rotor blade is modified as compared to a rotor blade not containing a removed portion in a dovetail slot thereof; and at least one damping mass loosely fittable into said dovetail adjacent said removed portion, said damping mass including means for frictionally damping motion of at least a portion of said rotor blade.

2. A rotating component according to claim 1 wherein said at least one damping mass includes first and second damping masses symmetrically disposed in said dovetail slot in said removed portion.

3. A rotating component according to claim 1 wherein said at least one damping mass includes only one damping mass symmetrically disposed in said dovetail slot in said removed portion.

4. A rotating component according to claim 1 wherein said removed portion is asymetric with respect to a longitudinal axis of said dovetail and said at least one damping mass includes only one damping mass asymetrically disposed in said dovetail slot in said removed portion, the asymetry of said removed portion and the disposition of said damping mass being effective to damp motion of said rotor blade in a first direction differently than in a second direction.

5. A rotating component comprising:

a wheel;

at least one dovetail slot in a peripheral surface of said wheel;

at least one rotor blade;

said rotor blade including an aerodynamic portion and a dovetail;

said dovetail being fittable within said dovetail slot for cantilevered support of said aerodynamic portion radially outward from said wheel;

a removed portion of said dovetail within said dovetail slot, said removed portion being effective to form a platform portion on said dovetail adjacent a root portion of said aerodynamic portion, said platform portion being substantially unsupported by said dovetail slot;

at least one of an extent and a location of said platform portion being effective for modifying a support of said dovetail by said dovetail slot, as compared to a dovetail not containing a removed portion, whereby a stress in said rotor blade is modified as compared to a rotor blade not containing a removed portion in a dovetail thereof;

at least one damping mass loosely disposed within said removed portion; and said damping mass, said dovetail and said removed portion including means for permitting centrifugal force to urge said damping mass radially outward into frictional engagement with both said blade and said dovetail slot whereby frictional damping of motion of said blade is produced.

6. A rotating component according to claim 5 wherein said at least one damping mass includes first and second damping masses symmetrically disposed in said removed portion.

7. A rotating component according to claim 6 wherein said blade, said removed portion, said dovetail slot and said first and second damping masses include means for permitting said first and second damping masses to be urged into frictional contact by centrifugal force whereby additional frictional damping of motion of said blade is produced.

8. A rotating component according to claim 5 wherein said at least one damping mass includes only one damping mass symmetrically disposed in said dovetail slot in said removed portion.

9. A rotating component according to claim 5 wherein said removed portion is asymmetric with respect to a longitudinal axis of said dovetail and said at least one damping mass includes only one damping mass asymmetrically disposed in said removed portion and the disposition of said damping mass being effective to damp motion of said rotor blade in a first direction differently than in a second direction.

* * * * *